US008282502B1

(12) United States Patent
Angstead et al.

(10) Patent No.: US 8,282,502 B1
(45) Date of Patent: Oct. 9, 2012

(54) GOLF SWING TRACER MAT

(75) Inventors: Ronald A Angstead, Longmont, CO (US); Michael J DeSimone, Spring Hill, FL (US)

(73) Assignee: Michael DeSimone, Spring Hill, FL (US)

( * ) Notice: Subject to any disclaimer, the term of this patent is extended or adjusted under 35 U.S.C. 154(b) by 0 days.

(21) Appl. No.: 13/358,205

(22) Filed: Jan. 25, 2012

Related U.S. Application Data

(60) Provisional application No. 61/436,120, filed on Jan. 25, 2011.

(51) Int. Cl.
*A63B 69/36* (2006.01)

(52) U.S. Cl. ..... 473/278; 473/218; 473/409

(58) Field of Classification Search ..... 473/218, 473/257, 262, 266, 268, 269, 270, 272, 278, 473/279, 409, 422, 452
See application file for complete search history.

(56) References Cited

U.S. PATENT DOCUMENTS

| | | | | |
|---|---|---|---|---|
| 3,348,847 | A * | 10/1967 | Fischl | 473/262 |
| 3,815,923 | A | 6/1974 | Goduto | |
| 4,311,312 | A * | 1/1982 | O'Brien | 473/218 |
| 5,340,109 | A * | 8/1994 | Miller | 473/262 |
| 5,590,882 | A * | 1/1997 | Todd | 473/218 |

* cited by examiner

*Primary Examiner* — Nini Legesse
(74) *Attorney, Agent, or Firm* — Patent Law Offices of Rick Martin, P.C.

(57) ABSTRACT

A golfing training system consists of a trace mat made of non-resilient fiber material that shows the path of a golf club head brushed across it. The trace mat is mounted in a rectangular rubber frame with a top surface of artificial grass. Two string spools are mounted under the trace mat. A string alignment plate can be set to a training angle, then the trace mat is put in place over the alignment plate. Two alignment strings can be laid out. Then the player takes his swing, recording the club head path on the trace mat in relation to his two alignment strings.

7 Claims, 6 Drawing Sheets

GOLF SWING TRACER MAT

CROSS REFERENCE APPLICATIONS

This non-provisional application claims priority from provisional application Ser. No. 61/436,120 filed Jan. 25, 2011.

FIELD OF INVENTION

The present invention relates to forming a mat with small synthetic fibers that appear as a solid field with a uniform look. When a golf club stroke passes across the fibers, they move and stay in an opposite direction creating an obvious contrast, thus tracing the golf swing.

BACKGROUND OF THE INVENTION

U.S. Pat. No. 3,815,923 (1974) to Goduto discloses a golf swing analysis mat. Two colored plastic fiber are heat fused together. One color is light and the other dark. The fibers are cut with a rectangular lower third. The main shaft of each fiber has sloped sides, and the top is flat. When a golf club crosses the surface of the mat, it traces a path of travel. The fibers are non-resilient, thus they remain bent over exposing an opposite color to the contrasting color shown when in the upright position.

What is needed in the art is a simple and cost effective fiber mat that displays contrasting shading when brushed with a golf club. What is also needed is a stroke alignment system combined with the trace mat to teach a player how his swing differs from his ideal swing.

The present invention provides a synthetic off the shelf mat having an obvious contrast when brushed. The circular mat is mounted in a stroking artificial grass mat with sight lines and retractable spools of string used to lay out an ideal swing.

SUMMARY OF THE INVENTION

The main aspect of the present invention is to provide a training mat having one colored fiber that lies sown when brushed so as to display the path of a golf stroke.

Another aspect of the present invention is to mount the mat in an artificial grass mat such that it is rotatable and can be aligned at angles with its built in alignment lines. Another aspect of the present invention is to mount two reels of string under the artificial grass mat for laying out ideal swing paths.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
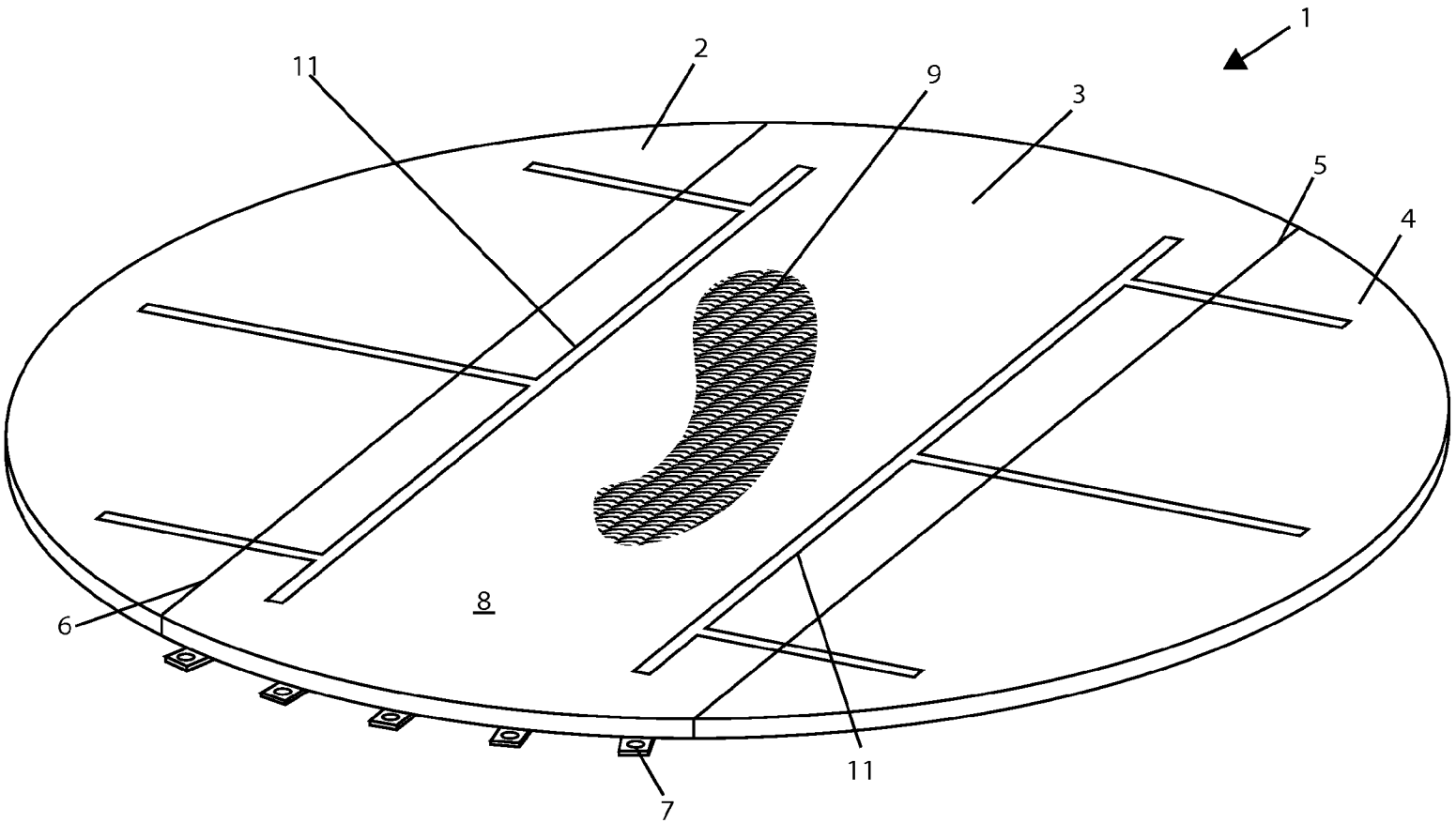
FIG. 1 is a top perspective view of the tracer mat showing a hook shot left.

FIG. 1 shows a tracer mat 1 make of a central plank 3 and planks 2, 4 which are hinged at 5,6. The top tracing surface 8 consists of a synthetic fiber mat manufactured by Fabric.com as model BF-312. The fibers are non-resilient so when the golf club swings across the central plank 3, the path of the swing is recorded or traced on the mat surface 8 as shown with the hook shot 9. After the swing the golfer can brush the fibers back to their natural alignment, and the trace 9 will disappear. The best mode uses a 100% polyester fabric with about six thousand bundles of fibers per square inch. Each bundle of fibers having about one hundred fibers per bundle, or in the range of about 50 to about 100 fibers per bundle. The height of each fiber is about 0.10 inch.

Figure 2:
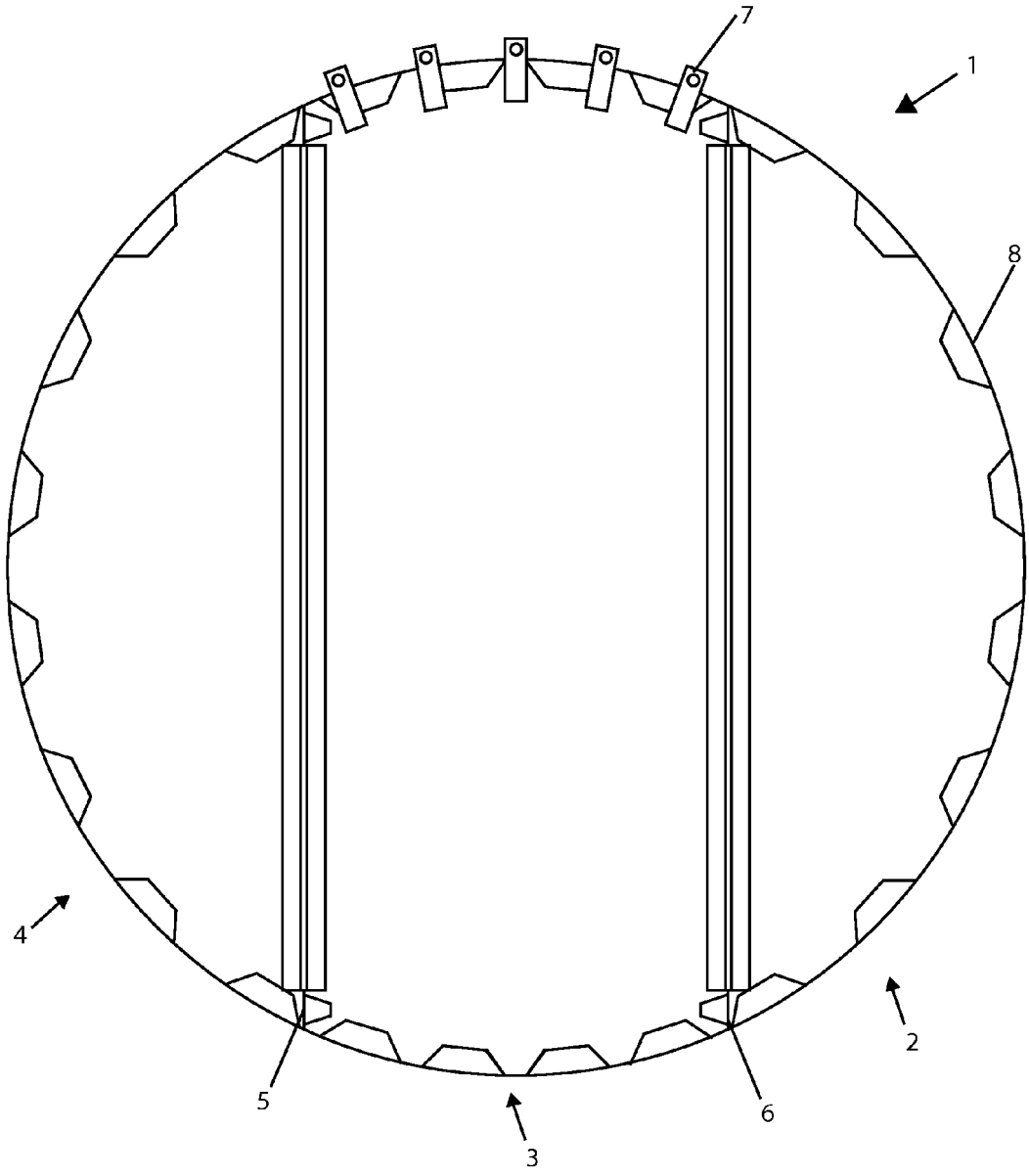
FIG. 2 is a bottom plan view of the tracer mat.
Figure 3:
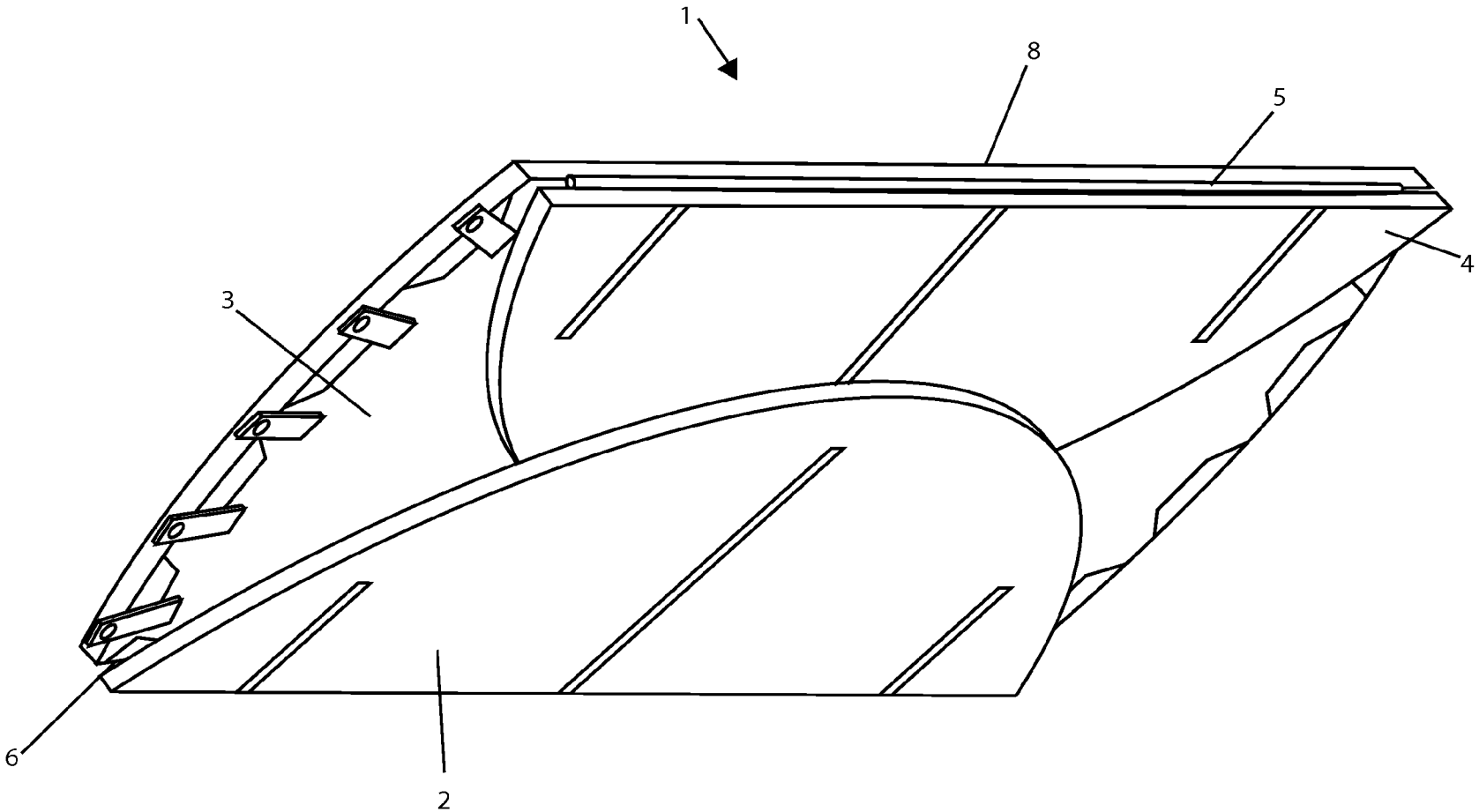
FIG. 3 is a bottom perspective view of the tracer mat folded up.

In FIGS. 2, 3 the tracer mat 1 is shown to consist of substrate members 2, 3, 4 preferably made of chipboard or plastic. The tracing surface 8 is glued and/or stapled to the substrate members 2, 3, 4. Mounting tabs 7 are optional.

Figure 4:
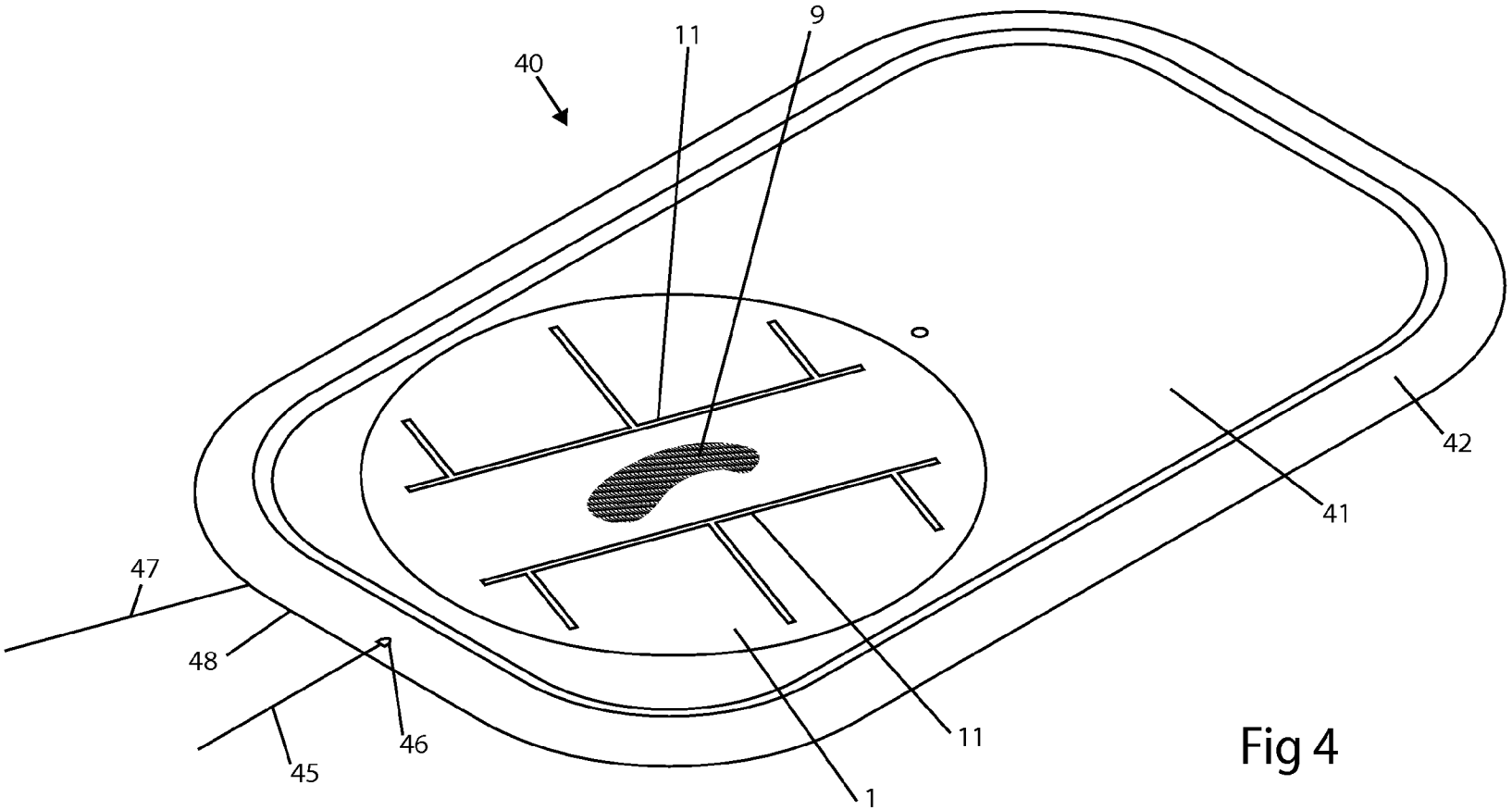
FIG. 4 is a top perspective view of the tracer mat installed on an artificial turf mat.
Figure 5:
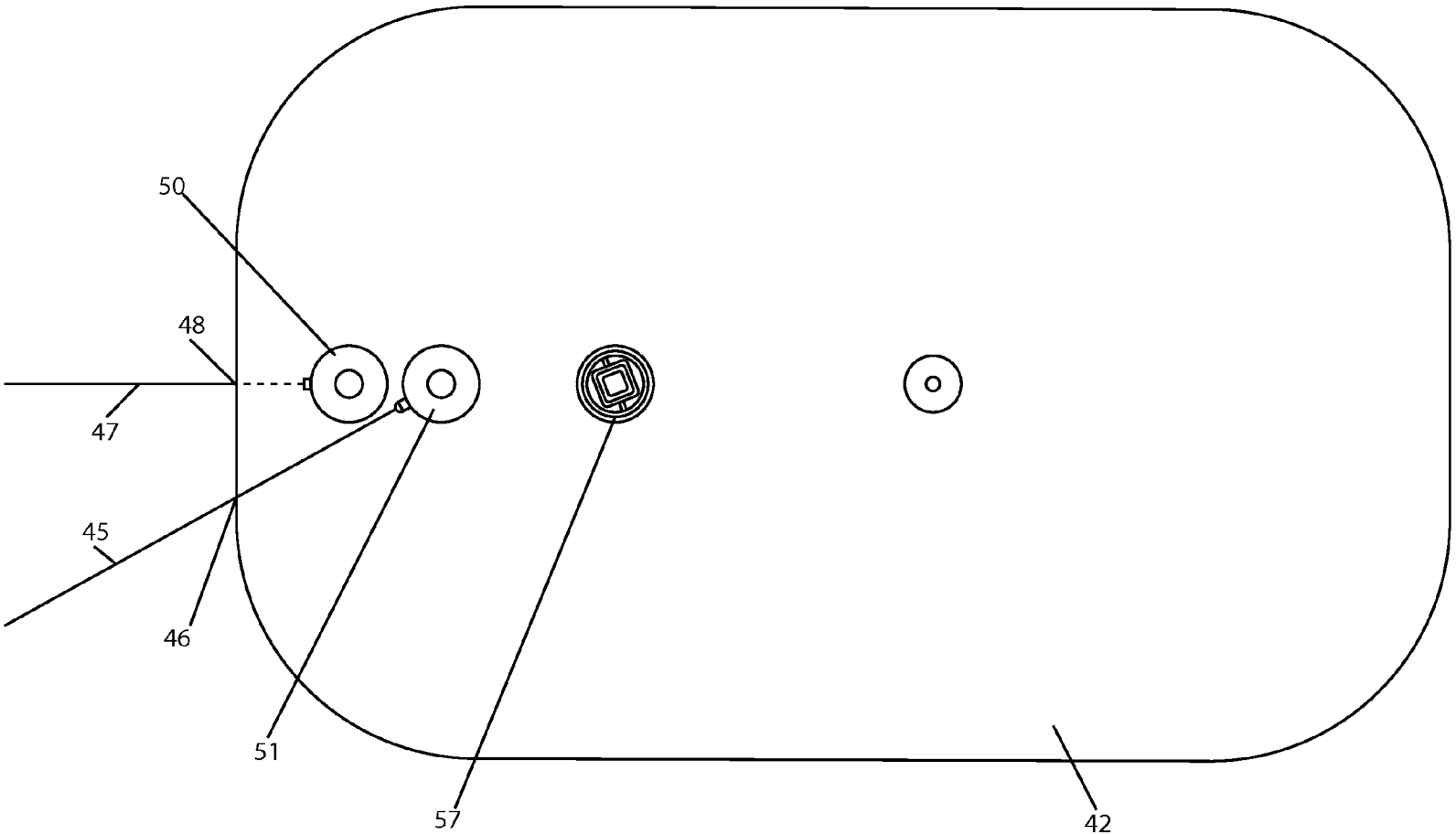
FIG. 5 is a bottom plan view of an alternative embodiment tracer mat.
Figure 6:
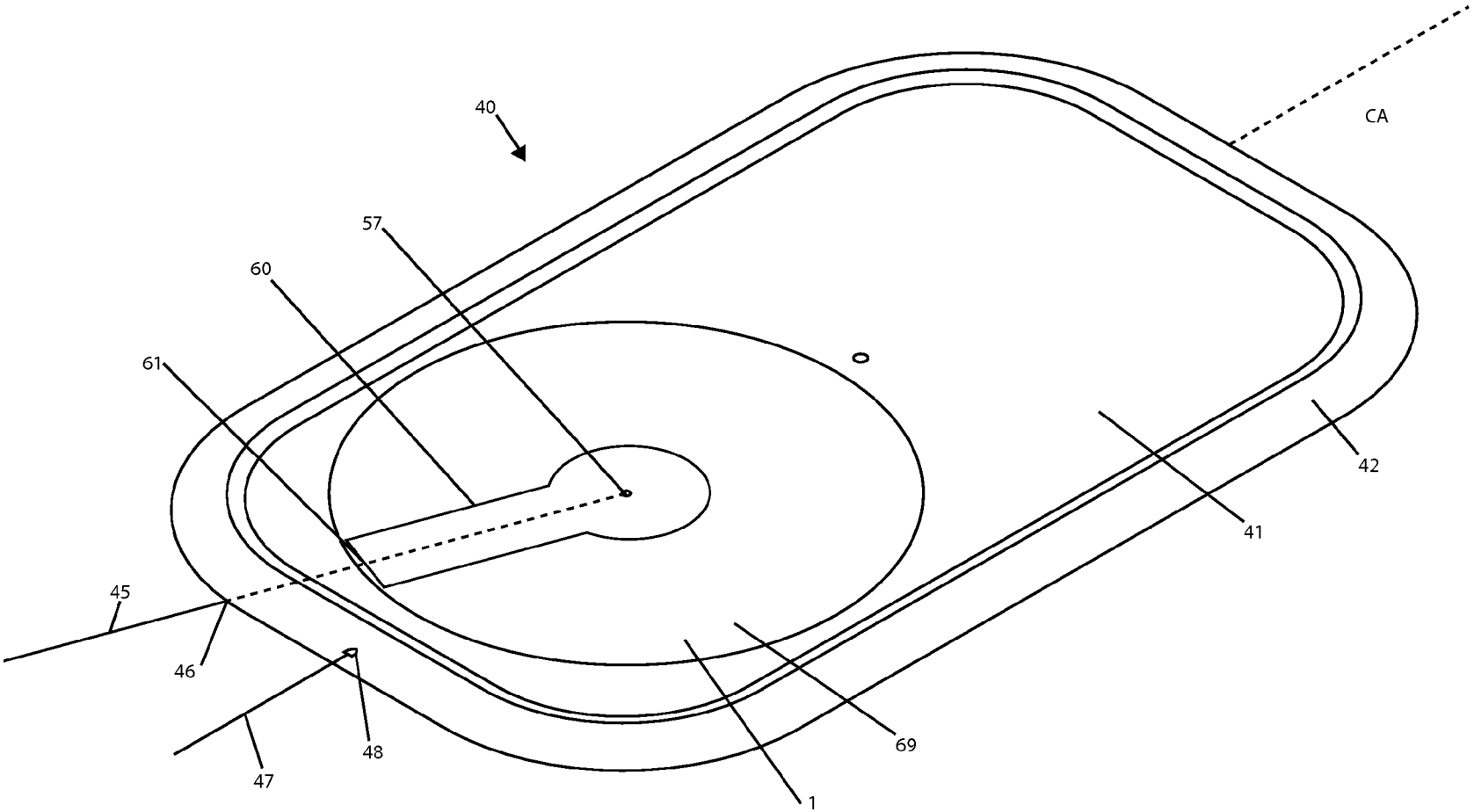
FIG. 6 is a top perspective view of an alternative embodiment tracer mat.

FIG. 4 shows the preferred embodiment swing mat 40. Swing mat 40 consists of an artificial grass surface 41 which is mounted in a rectangular frame 42. The trace mat 1 is rotatable in surface 41. The trace mat 1 has alignment lines 11 embedded therein. Under the surface 41 are two retractable string spools 50, 51 shown in FIG. 5. Spool 50 feeds string 47 out the channel 48, along the central longitudinal axis CA of the swing mat 40. Spool 51 feeds string 45 out the channel 46. The pivot rivet 57 supports the string angle plate 60 shown in FIG. 6.

The string angle plate 60 has a string hole 61 for threading string 45 through. The trace mat 1 is removed in FIG. 6. Then the string angle plate 60 is set to a desired training angle. Next the strings 45 and 47 are laid out several feet away from the frame 42. Next the trace mat 1 shown in FIG. 4 is placed into its cutout 69. Next the player takes his swing and makes a trace on the trace surface 8 as shown in FIG. 1.

Although the present invention has been described with reference to the disclosed embodiments, numerous modifications and variations can be made and still the result will come within the scope of the invention. No limitation with respect to the specific embodiments disclosed herein is intended or should be inferred. Each apparatus embodiment described herein has numerous equivalents.

We claim:

1. A golf swing training mat comprising:

a base swing mat having an artificial grass surface;

said base swing mat having a round recess with a diameter of at least one foot;

a round insert which is rotatable in the round recess;

said round insert further comprising a substrate covered with a swing indicating fiber mat;

said swing indicating fiber mat having a pair of parallel alignment lines thereon;

said base swing mat further comprising a bottom surface having a first retractable string spool thereon;

wherein an alignment string is drawn from the retractable string spool at a desired training angle;

wherein the pair of parallel alignment lines are set parallel to the alignment string;

wherein a golf club swing is made along the desired training angle; and wherein the indicating fiber mat indicates a trace of the golf club swing.

2. The golf swing training mat of claim 1 further comprising a second retractable string spool on the bottom and located adjacent a front edge of the base swing mat, wherein an alignment string feeds through a channel at the front edge along a longitudinal central axis of the base swing mat.

3. The golf swing training mat of claim 2 further comprising a string angle plate pivotally connected above the first retractable string spool in the round recess and under the round insert; said string angle plate having a string channel at its forward tip to provide an alignment guide for the string; and wherein the round insert is removable allowing the string angle plate to be set at a desired training angle and then the round insert put back in the round recess.

4. The golf swing training mat of claim 1, wherein the swing indicating fiber mat further comprises a polyester fabric with about six thousand bundles of fibers per square inch, each bundle of fibers having about fifty to one hundred fibers per bundle, each fiber having a height of about 0.10 inch.

5. A method to train a golf swing using a training mat, the method comprising the steps of:

forming a base mat having a round recess therein;

placing a round insert in the round recess so that the round insert is rotatable;

installing a fibrous material on the round insert, said fibrous material having an indicating means showing a swing trace thereupon;

placing a pair of parallel lines on the fibrous material;

rotating the parallel lines via the round insert to a desired shot angle;

swing a golf club at the desired shot angle on the fibrous material; and recording the swing pattern in the fibrous material via the indicating means.

6. The method of claim 5 further comprising the steps of mounting a string angle plate in the round recess, mounting a retractable string spool at a base of the string angle plate on a bottom of the base mat, extending the string thru a channel in the tip of the string angle plate to a desired shot angle, placing the round insert over the string angle plate with the parallel lines aligned with the string, swinging a golf club at the desired angle, and recording the golf club swing on the fibrous material.

7. The method of claim 6 further comprising the step of mounting a second retractable spool adjacent a front edge of the base swing mat, and extending a second string out along a longitudinal central axis of the base mat.

* * * * *